US012680488B2

(12) United States Patent
Weyer et al.

(10) Patent No.: US 12,680,488 B2
(45) Date of Patent: Jul. 14, 2026

(54) MULTI-STAGE EMISSION SYSTEM FOR LARGE DISPLACEMENT COMPRESSION IGNITION NON-ROAD DIESEL GENERATOR SYSTEMS FOR EMERGENCY AND NON-EMERGENCY STATIONARY POWER APPLICATIONS

(71) Applicant: Bluefin ESI, Inc., Lincoln, RI (US)

(72) Inventors: Guillermo Weyer, Lincoln, RI (US); Marcelo Lorenzo-Luaces Pico, Purcellville, VA (US)

(73) Assignee: Bluefin ESI, Inc., Lincoln, RI (US)

( * ) Notice: Subject to any disclaimer, the term of this patent is extended or adjusted under 35 U.S.C. 154(b) by 0 days.

(21) Appl. No.: 19/326,353

(22) Filed: Sep. 11, 2025

(65) Prior Publication Data

US 2026/0146552 A1 May 28, 2026

Related U.S. Application Data

(60) Provisional application No. 63/746,041, filed on Jan. 16, 2025, provisional application No. 63/725,456, filed on Nov. 26, 2024.

(51) Int. Cl.

| | |
|---|---|
| ***F01N 3/20*** | (2006.01) |
| ***F01N 3/033*** | (2006.01) |
| ***F01N 3/10*** | (2006.01) |

(52) U.S. Cl.

CPC ..... *F01N 3/208* (2013.01); *F01N 3/0335* (2013.01); *F01N 3/103* (2013.01); (Continued)

(58) Field of Classification Search

CPC ..... F01N 3/208; F01N 3/0335; F01N 3/103; F01N 2230/02; F01N 2590/08; F01N 2590/10; F01N 2610/02

See application file for complete search history.

(56) References Cited

U.S. PATENT DOCUMENTS 6,823,660 B2 11/2004 Minami
8,151,558 B2 4/2012 Robel et al.
(Continued)

FOREIGN PATENT DOCUMENTS

CN 118327749 A * 7/2024 ..... F01N 9/005
CN 118162127 A 11/2024
(Continued)

*Primary Examiner* — Jesse S Bogue

(74) *Attorney, Agent, or Firm* — Hinckley, Allen & Snyder, LLP; David R. Josephs

(57) ABSTRACT

A multi-stage emissions treatment system is disclosed for non-road, medium-speed, large-displacement diesel generator applications. The system integrates an onboard in-cylinder exhaust gas recirculation system with a downstream low temperature selective catalytic reduction unit that utilizes aqueous ammonia as a reductant agent. The combination enables ultra-low nitrogen oxide ($NO_x$) emissions performance at exhaust temperatures below those required for urea-based SCR systems. The engine, such as Wabtec's 250 series, operates at medium speeds (300-1,200 RPM) and supports both emergency and non-emergency use cases, including compliance with EPA Tier 4 Final standards. The system provides inducement resilience by maintaining EPA Tier 4 compliance in the event of SCR failure. High torque and inertia characteristics allow the generator to effectively respond to transient loads typical of artificial intelligence workloads. The invention enables the first viable use of medium-speed, large-displacement diesel engines in emissions-constrained, multi-engine stationary power sites such as data centers.

32 Claims, 5 Drawing Sheets

(52) U.S. Cl.
CPC ..... *F01N 2230/02* (2013.01); *F01N 2590/08* (2013.01); *F01N 2590/10* (2013.01); *F01N 2610/02* (2013.01)

(56) References Cited

U.S. PATENT DOCUMENTS

| | | | | |
|---|---|---|---|---|
| 9,656,210 | B2 * | 5/2017 | Wittrock | F01N 13/009 |
| 9,878,767 | B2 * | 1/2018 | Dahlberg | F02D 41/0025 |
| 10,340,697 | B2 * | 7/2019 | Paine | F01N 3/2066 |
| 10,371,029 | B2 * | 8/2019 | Sakuma | F01N 3/0814 |
| 2010/0058746 | A1 | 3/2010 | Pfeifer et al. | |
| 2014/0116027 | A1 | 5/2014 | Ancimer | |
| 2014/0331978 | A1 | 11/2014 | Goetzke et al. | |
| 2015/0036254 | A1 | 2/2015 | Emert et al. | |
| 2017/0098956 | A1 | 4/2017 | Sarti | |
| 2017/0341022 | A1 | 11/2017 | Andersen et al. | |
| 2018/0109112 | A1 | 4/2018 | Paine et al. | |
| 2019/0353094 | A1 | 11/2019 | Mokdad et al. | |
| 2023/0042829 | A1 | 2/2023 | Cohn et al. | |

FOREIGN PATENT DOCUMENTS

| | | | |
|---|---|---|---|
| KR | 10-1727923 | B1 | 4/2017 |
| WO | 2009099528 | A2 | 8/2009 |

* cited by examiner

MULTI-STAGE EMISSION SYSTEM FOR LARGE DISPLACEMENT COMPRESSION IGNITION NON-ROAD DIESEL GENERATOR SYSTEMS FOR EMERGENCY AND NON-EMERGENCY STATIONARY POWER APPLICATIONS

CROSS REFERENCE TO RELATED APPLICATIONS

This application is related to, and claims benefit from, U.S. Provisional Patent Application No. 63/725,456, filed on Nov. 26, 2024, entitled "MULTI-STAGE EMISSION SYSTEM FOR LARGE DISPLACEMENT COMPRESSION IGNITION NON-ROAD DIESEL GENERATOR SYSTEMS FOR EMERGENCY AND NON-EMERGENCY STATIONARY POWER APPLICATIONS," and U.S. Provisional Patent Application No. 63/746,041, filed on Jan. 16, 2025, entitled "MULTI-STAGE EMISSION SYSTEM FOR LARGE DISPLACEMENT COMPRESSION IGNITION NON-ROAD DIESEL GENERATOR SYSTEMS FOR EMERGENCY AND NON-EMERGENCY STATIONARY POWER APPLICATIONS," both of which are incorporated by reference in their entirety, herein.

BACKGROUND OF THE INVENTION

The method, device and composition of the present invention relates to the utilization of medium speed large displacement compression ignition non-road diesel engines, originally intended for rail and marine use, and adapting them to provide a power generation for emergency and non-emergency stationary power for the datacenter industry and others.

The invention relates to a multi-stage emissions treatment system combining an engine-integrated onboard Exhaust Gas Recirculation (EGR) and low temperature Selective Catalytic Reduction (SCR) to enable such engines to be successfully used as a viable technology for emission constrained sites such as datacenters and others. The use of medium speed large displacement engines offers enhanced reliability, and improved performance ideal for managing dynamic load conditions common in Artificial Intelligence (AI) based computing environments as well as unlocking the ability to participate in grid-supporting activities like demand response programs.

In particular, the invention pertains to the integration of medium-speed engines from the Westinghouse Air Brake Technologies Corporation (Wabtec) 250 engine family, such as the 250 SDC and 250 MDC platforms (hereinafter referred to as "the Wabtec 250 engine family") or equivalent engines. These engines are paired with a low-temperature aqueous ammonia SCR system to achieve ultra-low Nitrogen Oxides (NOx) emissions, surpassing EPA Tier 4 compliance thresholds and enabling their deployment at emissions-constrained, multi-engine sites for the first time.

Data centers and other multi-engine stationary sites aim to operate under Title V of the U.S. Clean Air Act and are subject to stringent emissions limits set by federal, state, and local regulatory authorities. These facilities must often comply with emissions thresholds for nitrogen oxides (NOx), carbon monoxide (CO), hydrocarbons (HC), and particulate matter (PM). When emissions exceed specified thresholds, the site may be classified by regulators as a "major source". Ongoing reductions in air quality have led to regulatory "attainment rezoning," where regions are reclassified to reflect non-attainment with lower emissions thresholds, resulting in limited data center development.

Stationary power engines are classified by their intended use under the guidance of ISO8528. There are essentially two types of engines use cases, non-emergency and emergency. Under current regulations, non-emergency engines are used for prime power, peak shaving, or demand response to help support the grid and thus must be Tier 4 certified. Emergency Standby Power (ESP) is typically used for less than 500 hours per year. Under current regulations, emergency standby engines typically operate only during unplanned power outages and are subject to less stringent Tier 2 or Tier 3 standards. Typically, a prime power engine is meant to operate continuously with the ability to manage load fluctuations and thus must adhere to stricter emissions criteria.

Tier 4-certified engines must demonstrate compliance with emissions performance through EPA-approved testing and certification. In contrast, Tier 4-compliant engines may only reflect design intent and not verified emissions performance.

EPA Tier 4 emissions limits are categorized based on engine displacement: 1) Engines ≤10 L/cylinder must meet stricter limits (e.g., NOx≤0.67 g/kWh) and 2) Engines >10 L/cylinder but ≤30 L/cylinder, which are classified herein as "large-displacement engines", are permitted higher NOx levels (up to 1.8 g/kWh). Historically, higher NOx limits rendered large-displacement engines an unattractive solution for Title V-regulated facilities like data centers.

The allowable Tier 4 NOx emissions (g/kWh) from a large displacement engine (1.8 g/kWh) is significantly higher than the allowable emissions of a small displacement (<10 L/cylinder) engines which is (0.67 g/kWh), roughly 300% more, which is why adoption of large displacement engines for datacenter applications has not been accepted as a viable technology.

Medium-speed engines (e.g., 300-1,200 RPM), such as those in the Wabtec 250 family, offer favorable torque and inertia characteristics, but historically have not been used in data centers due to high NOx output. These engines are commonly used in marine propulsion, rail traction, and limited prime power generation.

There are many emissions compliance technologies that are applicable to diesel engines. These include EGR (Exhaust Gas Recirculation), SCR, (Selective Catalytic Reduction), DOC, (Diesel Oxidation Catalyst), and Active or Passive DPF, (Discrete Particulate Filter). EGR reduces NOx by recirculating cooled exhaust gas back to the intake, lowering combustion temperatures. SCR reduces NOx through a catalytic reaction with a reductant, commonly urea or ammonia, injected into the exhaust stream that passes across a selective catalyst that reduces NOx emissions. DOC which oxidizes CO and HC. Lastly an ADPF is a special type of particulate control device that introduces active regeneration by employing an external heat source to burn off particulates.

In the industry, one challenge with medium speed large displacement EGR-equipped engines is that the exhaust temperatures produced by EGR-treated exhaust are significantly lower than traditional high speed engines (>1200 RPM), and as such the required temperature for effective hydrolysis to convert urea into ammonia in a typical SCR is not achieved. As a result, urea-based SCR systems may underperform in such conditions. In contrast, high-speed engines typically generate higher exhaust temperatures, making them more compatible with conventional urea-based SCR technologies. Medium-speed engines inherently produce cooler exhaust temperatures compared to high-speed engines. When combined with an integrated EGR system, these temperatures can fall below the effective operating range of urea-based SCR systems, impairing their ability to convert NOx. To address this limitation, the present invention employs an aqueous ammonia-based SCR system specifically designed to perform reliably under lower-temperature exhaust conditions. The preferred aqueous ammonia concentration for this invention is less than 20%.

In many regions, developers of large data centers and other mission-critical facilities are constrained in the number of emergency backup generators that can be deployed on a single site due to the potential to emit under Title V permitting limits under the U.S. Clean Air Act and equivalent state and local air quality regulations. Conventional large-displacement diesel engines, even when Tier 4 certified, emit nitrogen oxides at levels that quickly exceed sitewide emissions limits, which impacts the number of engines that may be installed and thereby restricting site scale.

This limitation delays the ability of developers to construct large, multi-engine installations in emissions-constrained regions where air permitting authorities impose strict NOx thresholds. Consequently, facilities must either reduce the number of generators installed or seek offsets and complex permitting pathways, both of which significantly increase cost and development timelines.

Further, under the U.S. Federal Energy Regulatory Commission (FERC) frameworks, including Order No. 845 (generator interconnection reforms) and Order No. 2222 (participation of distributed energy resources in wholesale markets) or other equivalent international regulating bodies, stationary generators may participate in ancillary services markets, demand response programs, and grid support functions provided they meet applicable emissions and operational requirements. Conventional Tier 4 solutions for both small and large-displacement engines have not provided sufficient emissions headroom to enable such participation, particularly for non-emergency use cases such as peak shaving, demand response, or spinning reserve.

The present invention addresses these unmet needs by providing ultra-low NOx (ULN) performance through the integration of onboard in-cylinder EGR coupled with a downstream low-temperature SCR system utilizing aqueous ammonia. By achieving NOx levels significantly below the 0.67 g/kWh Tier 4 Final threshold for small-bore engines, the invention allows developers to:

1. Expand site capacity by installing a larger number of medium-speed, large-displacement generators within strict Title V emissions caps, enabling buildout of large datacenter "templates" in regions where prior art technology would be disqualified.
2. Accelerate grid interconnections by providing the emissions performance necessary to qualify backup generators for non-emergency dispatch, ancillary services, and distributed resource participation, thereby supporting both customer reliability and broader grid stability.

The prior art and current systems are unable to use medium-speed, high-torque, large-inertia diesel gensets, such as the Wabtec 250 family, to handle dynamic load fluctuations consistent with AI and machine learning workloads because of high NOx emissions. The prior art fails to take advantage of these engines' higher torque, medium speed (e.g., 900 RPM), combined with large rotating mass (crankshaft, pistons, flywheel, alternator), which provides enhanced stability during large step loads, reducing the operational burden on Uninterruptible Power Supplies (UPS) systems.

These prior art and current systems are insufficient to meet these needs. For example, the prior art broadly discloses the use of EGR and SCR in internal combustion engines but lacks specific guidance or design criteria relevant to medium-speed, large-displacement, non-road diesel engines. Existing disclosures fail to address key parameters such as engine speed, displacement class, and power output, offering only generalized configurations applicable to all engine types.

Moreover, prior designs typically incorporate external exhaust components-including diesel oxidation catalysts (DOC), diesel particulate filters (DPF), and high-temperature urea-based SCR systems, which are often integrated within or upstream of the EGR loop. Additionally, urea-based SCRs are ineffective at low exhaust temperatures consistent with EGR-treated exhaust given that at lower temperature there is a high risk of incomplete urea hydrolysis. However, there is a need for a distinct system architecture with an onboard in-cylinder EGR system combined with a downstream low-temperature SCR stage, eliminating the need for DOC and DPF while achieving Tier 4 compliance in a simplified, optimized, and more reliable configuration tailored for non-road, large displacement engine applications.

Additionally, in prior systems, all the cylinders are collected and directed through one exhaust manifold wherein all the cylinders are subject to the EGR inlet. In these prior systems, there is no concept of implementing dedicated donor cylinders which exhaust directly out of the engine, which is fundamentally different in medium speed EGR designs amongst many manufacturers. The use of donor cylinders offers improved thermal control, combustion control, and manifold flow design.

Also, the use of urea as a reductant in prior systems is incompatible with the lower exhaust temperatures resulting from EGR operation in medium-speed engines. The present invention addresses this challenge by employing aqueous ammonia, which does not require thermal decomposition and is thus effective at lower exhaust temperatures (e.g., <300° C.).

Therefore, there is a need for a two-stage emissions treatment system combining onboard EGR and a low temperature aqueous ammonia SCR, suitable for large-displacement medium-speed engines operating in non-road stationary power applications, particularly where Title V or AHJ emissions constraints apply.

There is yet another need for a two-stage emission treatment system that uses aqueous ammonia, rather than urea, in the SCR system for improved effectiveness at lower temperatures.

Further, there is a further need for an emission treatment system that can perform in both an emergency and a non-emergency applications, so that when an SCR malfunctions and inducement restriction occur, the generator can still be categorized as Tier 4 Final certified and be used in an emergency application, while avoiding shutdown or engine derating.

There is another need for a large displacement medium speed, 900 RPM, prime power generator system that can sufficiently reduce NOx emissions to maintain Title V or AHJ air quality compliance.

There is a need for a medium-speed, large-displacement, compression ignition prime power generator system that can reliably manage the dynamic loading fluctuations of AI workloads.

There is a need for the utility of inducement resilience, particularly when operating in non-emergency use cases, a concept that is unlocked by this invention.

There is a need for a medium speed large displacement engine with sufficiently low exhaust temperatures to extend the useful life of an SCR catalyst.

There is a need for an engine to complement the use of aqueous ammonia as a reductant to allow for faster dosing times to reduce the number of uncontrolled hours of operation.

There is a need for a medium-speed, large-displacement, compression ignition prime power generator system that can better handle the dynamic fluctuations of AI-workloads and reduce the number of operations on an Uninterruptible Power Supply (UPS).

There is a need for a generator emissions system that allows developers of data centers and other mission-critical facilities to both increase site capacity in emissions-constrained regions and participate in non-emergency applications that support the electric grid through planned operation activities.

The present invention addresses this unmet need by providing an ultra-low NOx (ULN) architecture combining onboard EGR with low-temperature aqueous ammonia SCR, thereby enabling:

a. Larger build-outs of datacenters and multi-engine sites in regions subject to strict Title V or equivalent emissions permitting thresholds; and
b. Qualification for non-emergency dispatch and grid services, allowing operators to accelerate interconnection timelines and contribute to grid stability while maintaining mission critical availability of engines for emergency use.
c. Reduces duration of uncontrolled emissions by employing a low temperature aqueous ammonia based SCR that can start dosing reductant earlier than a urea-based SCRs that rely on higher temperature.

SUMMARY OF THE INVENTION

The present invention discloses a power generation system with multi-stage emissions treatment system for non-road, medium-speed, large-displacement compression ignition engines. The system integrates an onboard in-cylinder Exhaust Gas Recirculation (EGR) mechanism with an independent downstream Selective Catalytic Reduction (SCR) system utilizing aqueous ammonia, preferably less than 20% concentration, as the reductant agent. This combination enables significant reduction in nitrogen oxide (NOx) emissions while maintaining performance characteristics suitable for both emergency and non-emergency stationary applications, including those subject to Title V permitting requirements.

The present invention employs a distinct system architecture: an onboard in-cylinder EGR system combined with a downstream low-temperature SCR stage, eliminating the need for DOC and DPF while achieving Tier 4 compliance in a simplified, optimized, and more reliable configuration tailored for non-road, large-engine applications. The present invention addresses this challenge by employing aqueous ammonia instead of urea, which does not require thermal decomposition and is thus effective at lower exhaust temperatures.

More specifically, the present invention is configured to be inducement-resilient, allowing continuous operation of the engine in mission-critical scenarios even in the event of SCR malfunction or performance degradation. Engines that achieve Tier 4 using only EGR are not subject to inducement. The engine platform may be exemplified by the Wabtec 250 engine family or equivalent medium-speed engines with large displacement and integrated EGR systems.

Further, the present invention enables the use of medium-speed, high-torque, large-inertia diesel engines to handle dynamic load fluctuations from AI and machine learning workloads. The engines' low speed (e.g., 900 RPM), combined with large rotating mass (crankshaft, pistons, flywheel, alternator), provides enhanced stability during large step loads, reducing the operational burden on Uninterruptible Power Supplies (UPS) systems.

Torque output increases inversely with engine speed, as shown by:

$$T(\text{ft}-\text{lb}) = (5252 \times HP)/RPM$$

Thus, for the same power output, a 900 RPM engine delivers roughly double the torque of an 1800 RPM engine, improving responsiveness during load transients. It follows that:

$$T_{1800} = \frac{P \times 5252}{1800} \quad T_{900} = \frac{P \times 5252}{900}$$

Thus:

$$T_{900} \approx 2 \times T_{1800}$$

To generate 60 Hz power at 900 RPM, an 8-pole alternator is required, satisfying:

$$f = \frac{N \times P}{120}$$

where f is frequency, N is RPM, and P is number of poles.

The invention was demonstrated using the Wabtec 250 engine for example, which includes: 1) Inline engines: 6L250, 8L250, 2) V-type engines: 12V250, 16V250 with power ratings of 1,700-4,700 bkW at 900-1,000 RPM.

These engines incorporate an onboard in-cylinder EGR, high-pressure common-rail injection, multi-stage turbocharging, intercooling, and advanced combustion controls. The invention is not limited to a Wabtec 250 engine, and can be applied using other available medium speed, large displacement engines with onboard in-cylinder EGR emissions treatment systems that meet Tier 4 certification.

The present invention resolves a longstanding paradox that while SCR technology is widely adopted for advanced NOx reduction, it has not been combined with medium-speed, large-displacement engines that already utilize high-performance onboard EGR systems. The Wabtec 250 engine family, for example, exemplifies this challenge, where it was originally engineered for the rail and marine sectors to meet EPA Tier 4 emissions standards without relying on SCR or urea-based systems. It's integrated in-cylinder EGR system made it highly effective in those markets, particularly where SCR deployment was impractical or undesirable. However, applying these engines to emissions-constrained, stationary multi-engine sites introduces a conflict where to meet the stricter site-wide NOx limits, an SCR must be added despite the engine's original design intentionally avoiding it. The present invention overcomes contradiction by enabling a synergistic pairing of onboard in-cylinder EGR and low-temperature SCR, thereby unlocking a new class of ultra-clean, medium-speed power systems suitable for both emergency and non-emergency applications.

Selective Catalytic Reduction (SCR) systems are sensitive to sustained high exhaust temperatures, which can lead to accelerated catalyst degradation over time. Exposure to excessive heat may cause sintering of the catalyst material, reducing its active surface area and diminishing its $NO_x$ conversion efficiency. Prolonged operation at elevated temperatures can also accelerate chemical aging and reduce the structural integrity of the catalyst substrate, ultimately shortening the service life of the SCR system and compromising emissions performance.

In view of the above, an object of the present invention is to provide a diesel generator system incorporating the aforementioned multi-stage (EGR and SCR) emissions treatment architecture that minimizes greenhouse gas emissions, not only satisfies, but significantly exceeds EPA Tier 4 emissions standards, and maintains operability during both emergency and non-emergency use cases. Conventional Tier 4-certified medium-speed, large-displacement engines alone are not viable for stringent emission-constrained sites due to their limited emissions reduction capabilities under real-world operating conditions. Therefore, this invention introduces a substantially improved architecture that enables such engines to achieve ultra-low NOx levels, unlocking their use in regulated environments where prior art medium speed Tier 4 solutions for large displacement engines are insufficient by themselves.

Another object of the present invention is to provide a medium-speed, large-displacement prime power generator systems to simplify the emissions control architecture while enhancing reliability. Notably the system eliminates the need for a diesel oxidation catalyst (DOC) and diesel particulate filter (DPF) as a requirement to meet EPA Tier 4 compliance. Furthermore, the inherent operating characteristics of medium-speed engines enable effective accommodation of the additional exhaust backpressure resulting from the integration of a downstream selective catalytic reduction (SCR) system in combination with the engine's onboard exhaust gas recirculation (EGR) loop.

Yet another object of the present invention is to provide a SCR system optimized for low-temperature operation using aqueous ammonia (not urea) as the reductant agent, thereby improving NOx reduction effectiveness under the reduced exhaust temperatures typical of EGR-equipped engines.

Yet another object of the present invention is to enable medium-speed, large-displacement non-road diesel engines to meet and exceed current EPA Tier 4 Final NOx emissions requirements, facilitating their use in emissions-regulated sites, such as data centers, or large multi-engine sites subject to strict emissions constraints, where conventional high speed Tier 4 engines alone cannot meet regulatory thresholds and enhanced NOx reduction performance is essential. These engines have been classified by the inventors as Ultra-Low NOx (ULN).

Yet another object of the present invention is to reduce uncontrolled emissions by incorporating a low-temperature SCR that exhibits catalytic activity at lower temperatures, enabling reductant injection to begin earlier in the operating cycle. The system's ability to dose effectively at lower temperatures minimizes the delay between startup and NOx reduction, thereby lowering cold-start and low-load emissions typical of routine backup power testing. Starting reductant dosing earlier lowers the total NOx emitted during startup and supports ultra-low-NOx operation across duty cycles common to emergency stationary generators.

Additionally, a further object of the present invention is to leverage the mechanical benefits of large-displacement, medium-speed engines, including higher inertia and torque characteristics, to better support dynamic and cyclical loading conditions common in artificial intelligence (AI) and machine learning workloads, thereby reducing operational burden on Uninterruptible Power Supply (UPS) systems.

Still further, another object of the present invention is to extend the useful life of the SCR catalyst given the inherently lower exhaust temperatures characteristic of medium-speed, large-displacement engines equipped with onboard in-cylinder EGR. These lower thermal profiles reduce catalyst degradation, allowing for sustained NOx reduction performance and decreased maintenance frequency optimizing its use for non-emergency applications.

Another object of the present invention is to enable developers to deploy larger-scale data centers and other multi-engine facilities on emissions-constrained sites by providing ultra-low NOx performance from medium-speed, large-displacement generator systems. By achieving emissions levels significantly below applicable Tier 4 Final and international standards, the invention allows a greater number of generators to be installed within strict air permitting limits.

A further object is to permit these systems to participate in non-emergency applications, including demand response, ancillary services, and distributed energy resource markets, thereby accelerating utility interconnections and contributing to overall grid stability Lastly, another object of the present invention is to enable the effective use of aqueous ammonia as the reductant in selective catalytic reduction (SCR) exhaust aftertreatment systems. The use of aqueous ammonia provides improved low-temperature reactivity, which facilitates earlier and more efficient reductant dosing. As a result, uncontrolled operation of the SCR system during cold-start and transient conditions is reduced, thereby enhancing overall emissions control performance.

BRIEF DESCRIPTION OF THE DRAWING FIGURES

Further advantages, features and possible applications of the present invention are shown and described in the accompanying drawing figures.

DESCRIPTION OF THE INVENTION

The invention provides a non-road, stationary diesel generator system comprising a medium-speed, large-displacement compression ignition engine equipped with an integrated onboard Exhaust Gas Recirculation (EGR) system and a downstream Selective Catalytic Reduction (SCR) system utilizing aqueous ammonia (not urea). The system is configured to achieve ultra-low nitrogen oxide (NOx) emissions, significantly exceeding current EPA Tier 4 requirements, while providing inducement-resilient functionality.

The integration of an onboard in-cylinder exhaust gas recirculation (EGR) system with a low-temperature selective catalytic reduction (SCR) system enables the generator to achieve ultra-low nitrogen oxide ($NO_x$) emissions, thereby making it suitable for deployment in non-emergency applications governed by stringent air quality regulations. Unlike prior art systems, the invention provides inducement resilience, ensuring continued operability in non-emergency modes even in the event of SCR system malfunction.

The integration of an onboard in-cylinder EGR with a low-temperature SCR system enables the generator to achieve ultra-low NOx emissions, making it suitable for use in non-emergency applications subject to stringent air quality regulations. A key enabling feature is inducement resiliency—the ability of the system to maintain compliant operation even in the event of SCR malfunction. Because the EGR system alone ensures Tier 4-level NOx reduction, the generator avoids inducement-triggered restrictions that would otherwise limit or disable operation. This is particularly critical for emergency systems operating in non-emergency applications such as grid support, demand response, or continuous-duty operation, where uptime and regulatory compliance must be maintained simultaneously without interruption.

The medium-speed, large-displacement generator architecture is particularly advantageous for mission-critical environments, such as data centers, where highly variable and rapidly changing load profiles, including those associated with artificial intelligence (AI) workloads, demand elevated torque output, increased rotational inertia, and reliable emissions compliance under dynamic conditions.

Figure 1:
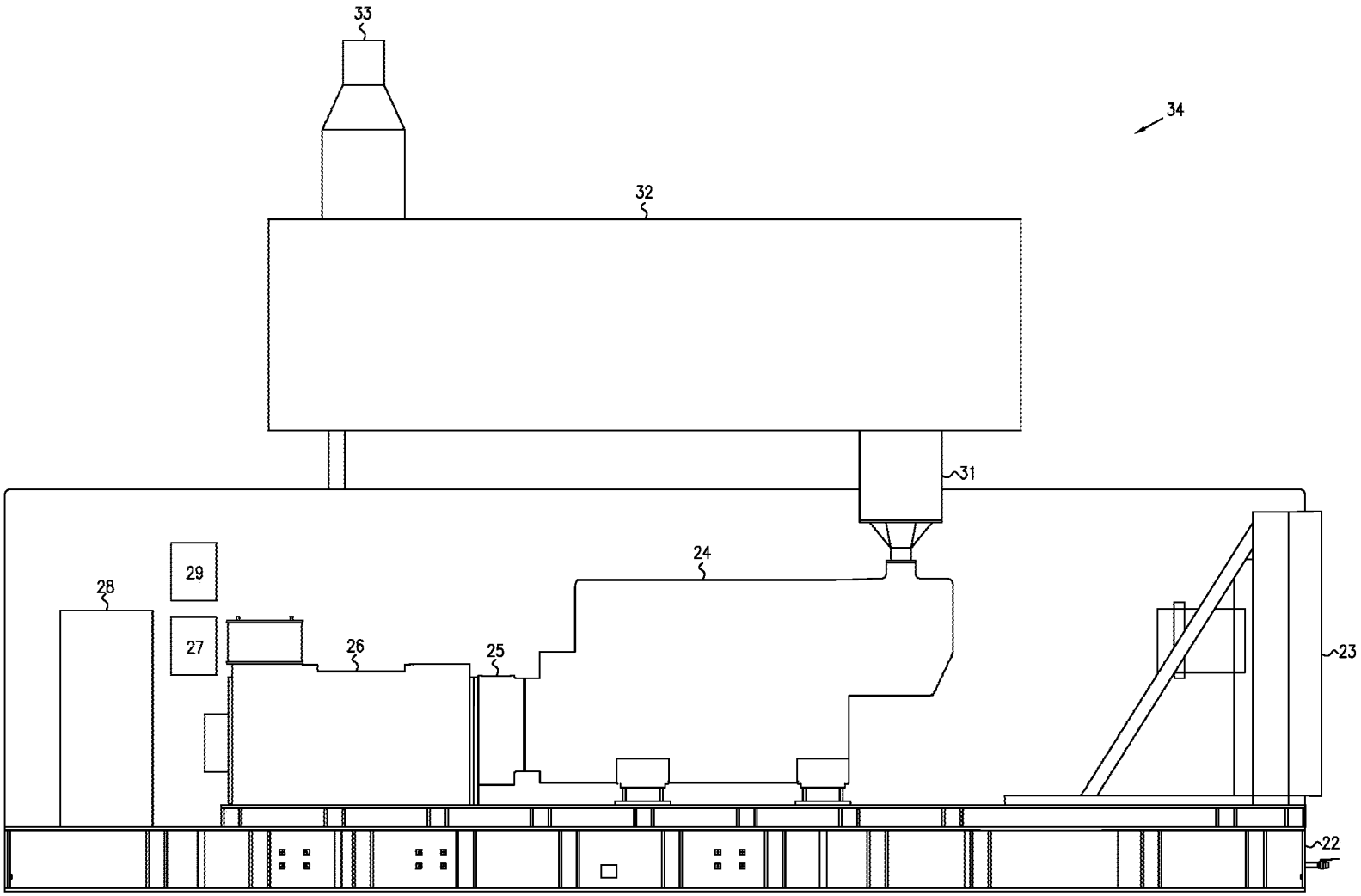
FIG. 1 is a side elevational schematic view of the preferred embodiment of the system of the present invention, which includes a generator set ("genset") equipped with a medium-speed, large-displacement diesel engine 24 incorporating an integrated in-cylinder Exhaust Gas Recirculation (EGR) system.

Referring to first to FIG. 1, the preferred embodiment of the invention is shown in detail to include a generator set (known as a "genset") 34 equipped with a medium-speed, large-displacement diesel engine 24 incorporating an integrated in-cylinder Exhaust Gas Recirculation (EGR) system. The engine 24 is mounted on a skid and fuel belly tank assembly 22, preferably mounted on the ground, and is mechanically coupled via a shaft coupler 25 to an alternator 26, preferably an 8-pole, 900 RPM alternator configured for the desired output voltage. The alternator 26 is electrically connected to power distribution switchgear 28. The engine governor and excitation and control systems 27. The generator 34 includes a fan and radiator assembly 23 for thermal management and enclosure ventilation to manage cooling of the engine and waste heat from both the engine 24 and alternator 26.

Post-combustion exhaust gases exit the engine 24 through the integrated onboard EGR system and flow into a downstream low temperature Selective Catalytic Reduction (SCR) system 32, via engine exhaust stack 31. The SCR system 32 utilizes aqueous ammonia as the reductant agent to facilitate the conversion of NOx to nitrogen and water vapor. Treated exhaust gases are released to atmosphere via a final exhaust stack 33. An SCR controller 29 monitors dosing and system health. The cooling package may be positioned either on the roof or at ground level as a standalone module, depending on site-specific requirements. FIG. 1 is intended to illustrate the constructability and key components of the invention, and does not represent a complete genset embodiment, which is well understood in the prior art.

The layout illustrated in FIG. 1 represents one possible embodiment of a configuration consistent with the principles of the present invention. It is understood that this depiction is illustrative and not intended to limit the present invention to a complete generator set system or any specific arrangement, as variations and adaptations within the scope of the art may be employed.

Figure 2:
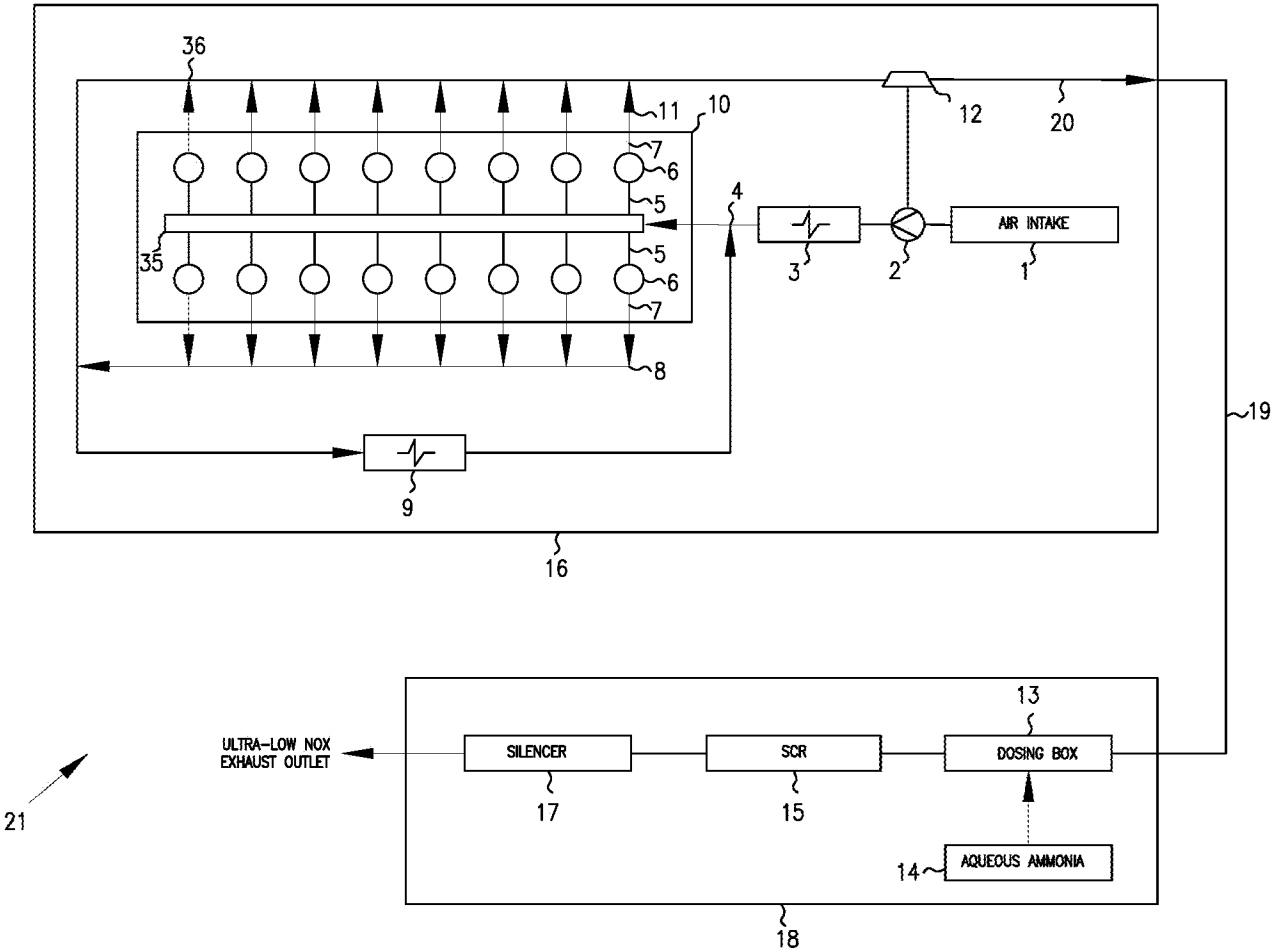
FIG. 2 shows a functional system diagram of the power generation system utilizing a medium-speed, large-displacement engine with integrated onboard EGR and subsequent SCR systems in accordance with the preferred embodiment of FIG. 1 of the present invention.

Referring now to FIG. 2, a diagram of functional system 21 of the power generation system is shown utilizing a medium-speed, large-displacement engine with integrated onboard EGR and subsequent SCR systems, corresponding to the embodiment of FIG. 1. Ambient intake air is drawn through an air intake 1, pressurized by a turbocharger compressor 2, and cooled via one or more intercoolers 3. There may be multiple turbocharger compression stages 2, and multiple intake coolers 3, that cool the intake air before mixing at 4, with recirculated exhaust into the air intake manifold 35. The cooled intake air is mixed with recirculated exhaust gases and routed to the intake manifold 35, through intake valves 5, and into combustion cylinders 6. After combustion, exhaust gases are diverted by an exhaust valve 7. A portion of the exhaust gases from selected donor cylinders 8 are redirected through an EGR cooler 9, then recirculated into the intake stream via 4 the EGR path as shown. The remaining exhaust combines with the non-donor cylinders 36 via exhaust valves 7 in the exhaust manifold or plenum 36 which are routed through a turbine 12 and exit the engine at output 20 and into the engine exhaust stack 19. Those that are skilled in the art understand that every medium speed large displacement engine manufacturer with an EGR design may have a proprietary method of employing turbos at various stages, they may also make use of selective donor cylinders in various configuration, and they may or may not employ valves to limit the flow of air in an EGR circuit, but the novelty of this invention is focused on the utility of combining EGR and SCR with a large displacement medium speed engines that comply with Tier 4 emissions standards, similar to the Wabtec 250 engine family, to achieve ultra-low NOx.

Still referring to FIG. 2, the EGR-treated exhaust then enters the SCR system via a post-EGR stack or plenum 19. Aqueous ammonia 14, sourced from an aqueous ammonia storage tank (not shown), is injected into the exhaust stream at a dosing box 13 where exhaust gases are allowed to thoroughly mix with reductant. The ammonia-exhaust mixture passes into an SCR catalyst chamber 15, where a selective catalytic reduction reaction occurs, converting NOx into nitrogen, water vapor, and other non-regulated compounds. The treated exhaust may then pass through a silencer 17 before releasing to the atmosphere.

The system may include an engine block 10 configured to at least partially define a plurality of cylinders item 6. Each cylinder being adapted to receive a piston assembly (not shown), where the combination of the cylinders and corresponding piston assemblies defines a plurality of combustion chambers within the engine.

The system of the present invention may also include an Active Diesel Particulate Filter ADPF. It is also possible, in accordance with the present invention, that a combination of ADPF and DOC may be provided. The ADPF provides reduced backpressure and desirable sound attenuation and may be incorporated into the system of the present invention. The configuration and order of exhaust treatment devices in FIGS. 2, 3, 4 and 5 can be arranged in various configurations, and it is not the intent of this invention to determine the exact configuration for every application. Those that are skilled in the art may apply the exhaust treatment devices in various configuration that best suits their application.

Figure 3:
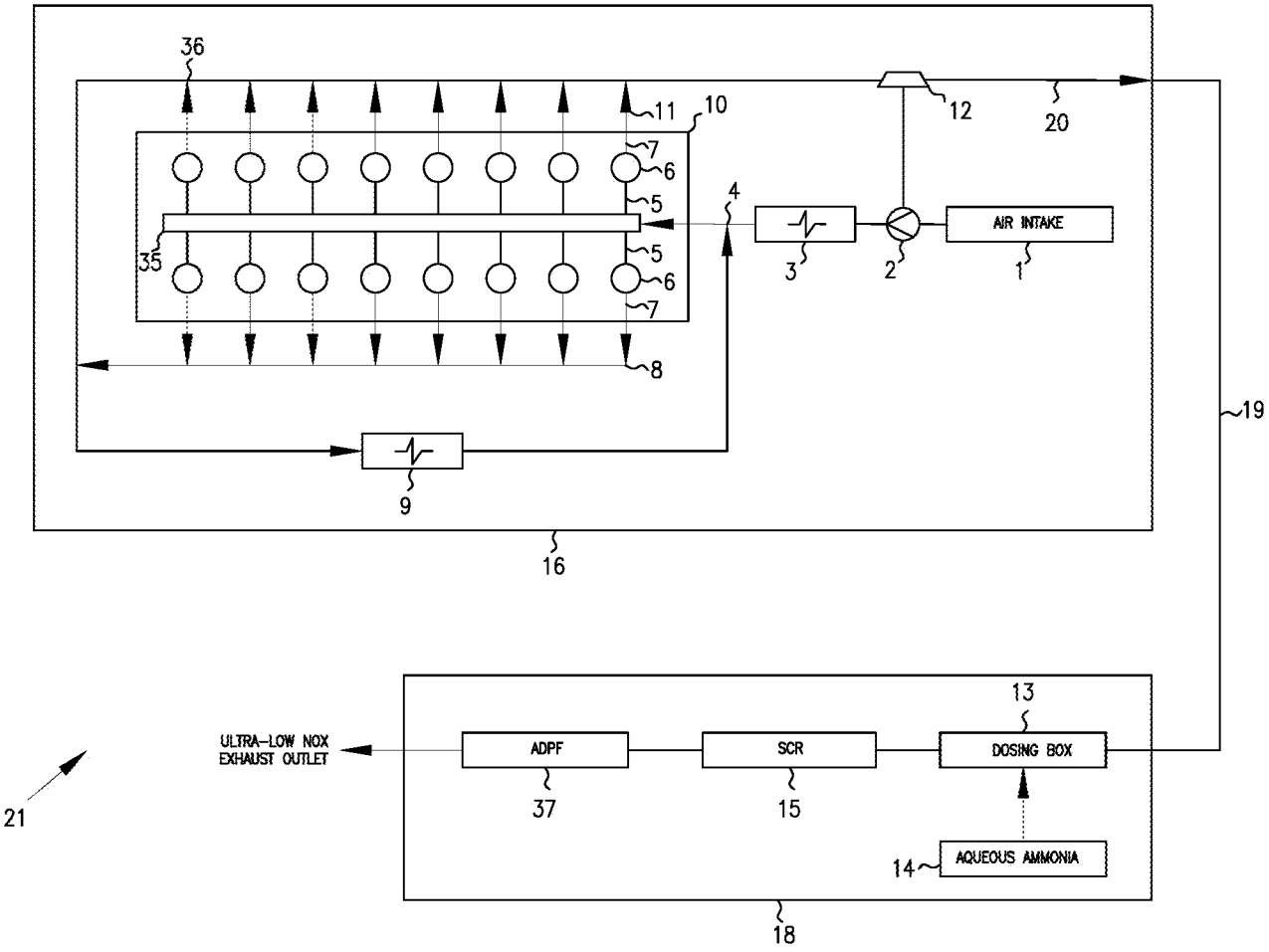
FIG. 3 shows an alternative embodiment of the system of the present invention with an optional Active Diesel Particulate Filter (ADPF) 37 positioned downstream of the SCR system.
Figure 4:
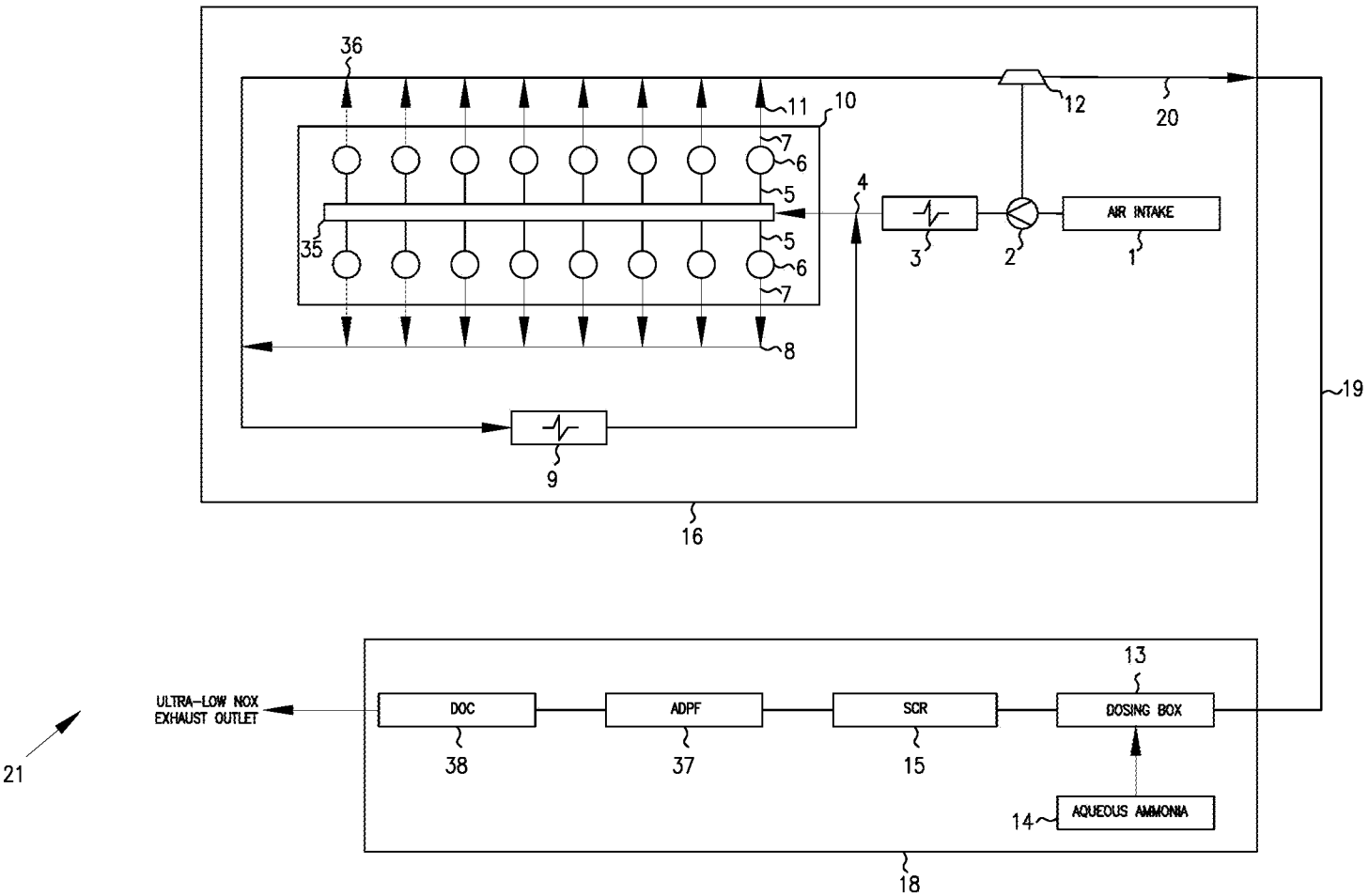
FIG. 4 shows an alternative embodiment of the system of the present invention where the ADPF 37 functions as a combined emissions and silencing component, thereby replacing or reducing the need for a conventional exhaust silencer 17.
Figure 5:
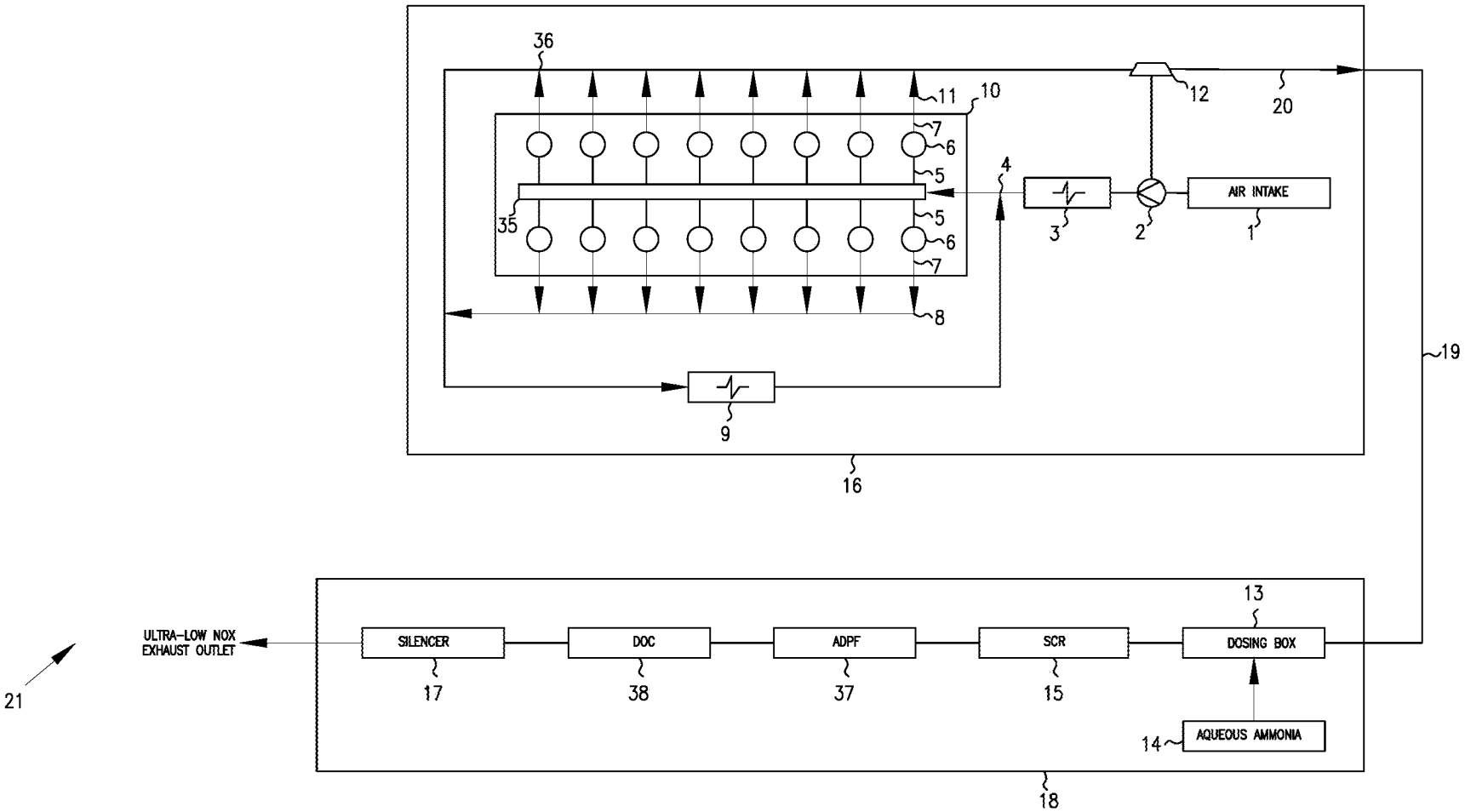
FIG. 5 shows an alternative embodiment of the system of the present invention with an optional Diesel Oxidation Catalyst (DOC) 38 combined with ADPF 37 and silencer 17 position downstream of the SCR system.

In some embodiments, referring to FIGS. 3, 4, and 5 the emissions system of the present invention 32 may optionally include various downstream configurations including but not limited to an Active Diesel Particulate Filter 37 to further reduce particulate matter, a diesel oxidation catalyst 38 to reduce carbon monoxide CO and Hydrocarbons HC. The ADPF 37, in certain configurations, may serve as a replacement for a conventional silencer, offering dual-purpose functionality for emissions and noise reduction and can be considered for all variations as site conditions require.

More specifically, in FIGS. 3 and 4, the second stage exhaust system 18 may additionally include an ADPF 37 or DOC 38 positioned downstream of the SCR system. While not required for Tier 4 compliant or certified in this invention, the ADPF and or the DOC may be optionally added to further reduce PM and CO emissions if being used in non-emergency applications requiring long annual run times.

In accordance with the present invention, a two-stage emissions control system is provided for a Tier 4-certified medium-speed, large-displacement diesel engine. The first stage 16 comprises an integrated EGR system capable of achieving Tier 4 emissions certification independently. The second stage emissions treatment system 18 incorporates an aqueous ammonia-based SCR system 13, 14, & 15 optimized for low-temperature operation, enhancing NOx reduction to levels below standard Tier 4 requirements.

The invention leverages the inherent backpressure tolerance of the engine 24 to accommodate the SCR system 18 without compromising performance. This dual-stage architecture enables ultra-low NOx operation while improving reliability across emergency and non-emergency duty cycles.

The ultra-low NOx allows developers enough emissions performance to participate in non-emergency applications, such as demand response, which provides a tool to help support grid stability, resiliency, and accelerate interconnections to continue the progress of AI deployment in energy constrained regions.

The system 16 and 18 of the present invention further provides a new concept of inducement resilience. If the SCR system 18 experiences a fault or degradation, the engine 16 remains operational for emergency use by having already satisfied Tier 4 certification via its integrated EGR system. An SCR watchdog controller 29 supervises SCR functionality and reports system alarm status without automatically triggering shutdown or power derating.

The EGR stage alone can achieve Tier 4 certification emission, while the SCR stage drives NOx to record breaking low levels. In the event of an SCR failure, the engine is not required to shutdown and can still participate in non-emergency applications with a higher emissions rate, but most importantly it will still be available for emergency applications. Together, they form a resilient system that supports both emergency and non-emergency applications.

Furthermore, in the present invention, the EGR path is upstream of the compressor 12, avoiding the potential contamination or backflow issues associated with post-compressor EGR seen in prior art systems. Also, in the present invention, the EGR and SCR systems operate independently, with no portion of the SCR-treated exhaust nor any exhaust treated by a diesel oxidation catalyst (DOC) or diesel particulate filter (DPF) being recirculated into the engine intake. This architectural separation prevents the risk of urea or ammonia slip from being introduced into the combustion chambers, thereby enhancing system reliability and combustion integrity.

The Wabtec 250 engine family, in particular, exemplifies the onboard in-cylinder EGR implementation used in the present invention. These engines comply with Tier 4 emissions standard as a result of their high combustion efficiency and low emissions thus not requiring DOC or DPF in the EGR loop. Their extended combustion dwell time (900 RPM), a characteristic of medium-speed engines, supports more efficient in-cylinder oxidation of CO and PM, reducing the need for downstream particulate control.

In view of the above, the present invention is distinguished from and a significant advancement over prior systems because of the following characteristics: (a) application to medium-speed (300-1,200 RPM), large-displacement (>10 L/cylinder) non-road diesel engines with integrated in-cylinder EGR, (b) Obviation of DPF, DOC, or SCR within the EGR exhaust recirculation loop; complementary secondary stage of exhaust treatment occurs independent from and downstream of the EGR loop, (c) Use of aqueous ammonia, not urea, as the low temperature SCR reductant to achieve more effective NOx reduction at lower exhaust temperatures, and (d) This invention establishes a novel emissions architecture that achieves the lowest NOx emissions ever recorded from an internal combustion diesel engine of its class, setting a new industry benchmark for the Lowest Achievable Emissions Rate (LAER) and Best Available Control Technology (BACT).

The invention goes beyond simply meeting the world's most demanding emissions standards, it offers a commercially available, scalable path toward cleaner, more responsible power generation for critical infrastructure and society at large. By combining a medium-speed, large-displacement engine, like the Wabtec 250 engine family or similar platforms, with an optimized onboard in-cylinder EGR system and downstream aqueous ammonia low temperature SCR, the present invention achieves exceptional NOx reduction while maintaining operational flexibility and reliability. This breakthrough enables the deployment of ultra-low emissions diesel technology in regions with strict air quality requirements, contributing to improved public health, reduced environmental impact, and a more sustainable energy future.

Thus, the present invention provides a breakthrough generator platform offering unprecedented emissions performance, operational reliability, and viability for deployment at large-scale, multi-engine mission-critical sites. The invention achieves industry-leading NOx reduction through its integration of medium-speed (e.g., 900 RPM) large-displacement engines, such as, but not limited to, the Wabtec 250 series, with low-temperature aqueous ammonia SCR aftertreatment. This configuration is particularly well-suited to emissions-constrained sites with multi-generator applications that also have high-variability loads typical to data-center sites and AI inference and training workloads.

The aforementioned examples are only one of the potentially many applications and modes of execution of the system of the present invention and common changes and substitutes made by technical personnel of this field within the technical proposal of this invention should be included in the protection scope thereof. It would be appreciated by those skilled in the art that various changes and modifications can be made to the illustrated embodiments without departing from the spirit of the present invention. All such modifications and changes are intended to be covered by the appended claims.

What is claimed is:

1. A multi-stage emissions treatment system for a non-road, medium-speed, large-displacement compression ignition diesel generator, comprising:

a diesel engine having a per-cylinder displacement between 10 and 30 liters, a rated output between 1,700 kW and 4,700 kW, and an operating speed between 300 and 1,200 revolutions per minute (RPM); the engine including an onboard integrated in-cylinder exhaust gas recirculation (EGR) system achieving EPA Tier 4 Certification as an independent and first-stage emissions reduction mechanism;

a second-stage emissions treatment stage, downstream and in fluid communication with the diesel engine, including a low temperature selective catalytic reduction (SCR) unit, positioned downstream of the EGR system, and configured to inject a reductant to convert nitrogen oxides ($NO_x$) into nitrogen and water vapor or other non-regulated compounds;

an EPA Tier 4 certified control system wherein the generator is operable in emergency and non-emergency applications, the control system being inducement-resilient whereby a malfunction or failure of the SCR system during non-emergency use does not trigger an engine shutdown, thereby maintaining mission critical availability of the engine;

wherein the system is configured to achieve emissions levels significantly lower than existing Tier 4 Final emissions requirement of small displacement (<10 L/cyl.), high-speed, engines (0.67 g/kW-h).

2. The system of claim 1, wherein the reductant is aqueous ammonia.

3. The system of claim 1, wherein the reductant is urea.

4. The system of claim 1, wherein the diesel engine is rated for prime power operation.

5. The system of claim 1, wherein the low temperature SCR unit includes a catalytic reaction chamber configured to receive aqueous ammonia as reductant and facilitate a selective catalytic reaction that reduces $NO_x$ to levels lower than the applicable EPA Tier 4 Final standards.

6. The system of claim 1, wherein the generator system is configured and arranged to provide emergency backup power in data center applications and accept rated electrical load within 30 seconds of start-up.

7. The system according to claim 1, wherein the generator is configured with a large displacement medium speed engine and arranged to support dynamic, high-variability computing workloads including artificial intelligence (AI), machine learning, and large language model (LLM) training;

the engine being configured and arranged with increased rotational inertia and torque output, compared to a similarly rated high speed engine (1800 RPM), sufficient to mitigate frequency and voltage instability during transient AI load events, wherein the need for UPS intervention, using an uninterruptable power supply (UPS), is reduced while improving data center reliability and throughput.

8. The system of claim 7, wherein reduced voltage and frequency deviations during AI workloads result in fewer transitions of the uninterruptible power supply (UPS) to battery mode, thereby improving UPS operational lifespan.

9. The system of claim 1, wherein the engine has a per-cylinder displacement of less than 10 liters.

10. The system of claim 1, wherein the generator system includes a medium-speed, large-displacement diesel engine in large multi-engine stationary power generation sites regulated under Title V or equivalent air quality permitting regimes.

11. The system of claim 1, wherein the engine and emissions treatment system operate without requiring a diesel oxidation catalyst (DOC) or diesel particulate filter (DPF) to comply with EPA Tier 4 emissions regulations of carbon monoxide (CO) and particulate matter (PM) limits.

12. The system of claim 1, wherein the system includes inducement-resilient architecture with reliable operation in both emergency and non-emergency mission-critical applications, reducing risk of emissions-related shutdown and enhancing system availability.

13. The system of claim 1, further comprising:

an Active Diesel Particulate Filter (ADPF) configured to reduce particulate matter emissions and optionally function as a sound attenuation device, wherein the ADPF replaces or supplements the exhaust silencer.

14. The system of claim 1, further comprising:

a passive diesel oxidation catalyst (DOC) positioned downstream of the engine and wherein the DOC is configured to further remove CO.

15. The system of claim 1, wherein the selective catalytic reduction (SCR) unit is configured to receive aqueous ammonia as the reductant, the aqueous ammonia providing improved low-temperature reactivity compared to urea, thereby enabling earlier and more efficient reductant dosing during cold-start and transient operation, reducing uncontrolled operation of the SCR system and enhancing overall emissions control performance.

16. The system of claim 1, wherein the ultra-low nitrogen oxide ($NO_x$) emissions performance enables developers to:

(a) deploy larger multi-engine stationary generator installations in emissions-constrained regions without exceeding Title V or local air quality permitting thresholds, thereby maximizing build-out capacity; and (b) accelerate grid interconnections by providing sufficient emissions margin to qualify the generator system for ancillary services, demand response, and distributed energy resource participation under Federal Energy Regulatory Commission (FERC) Orders 845 or 2222 or other equivalent international regulating bodies or electric utilities governing interconnection requirements.

17. A multi-stage emissions treatment system for a non-road, medium-speed, large-displacement compression ignition diesel generator, comprising:

a diesel engine having a per-cylinder displacement between 10 and 30 liters, a rated output between 1,700 kW and 4,700 kW, and an operating speed between 300 and 1,200 revolutions per minute (RPM); the engine including an onboard integrated in-cylinder exhaust gas recirculation (EGR) system as an independent and first-stage emissions reduction mechanism; the engine being configured and arranged with increased rotational inertia and torque output, compared to a similarly rated high speed engine (1800 RPM), sufficient to mitigate frequency and voltage instability during transient AI load events;

a second-stage emissions treatment stage, downstream and in fluid communication with the diesel engine, including a low temperature selective catalytic reduction (SCR) unit, positioned downstream of the EGR system, and configured to inject a reductant to convert nitrogen oxides (NOx) into nitrogen and water vapor or other non-regulated compounds;

wherein the need for UPS intervention is reduced while improving data center reliability and throughput;

wherein the system is configured to achieve emissions levels significantly lower than existing Tier 4 Final emissions requirement of small displacement (<10 L/cyl.), high-speed, engines (0.67 g/kW-h).

18. The system of claim 17, wherein the reductant is aqueous ammonia.

19. The system of claim 17, wherein the reductant is urea.

20. The system of claim 17, wherein the diesel engine is rated for prime power operation.

21. The system of claim 17, wherein the low temperature SCR unit includes a catalytic reaction chamber configured to receive aqueous ammonia as reductant and facilitate a selective catalytic reaction that reduces NOx to levels lower than the applicable EPA Tier 4 Final standards.

22. The system of claim 17, wherein the generator system is configured and arranged to provide emergency backup power in data center applications and accepting rated electrical load within 30 seconds of start-up.

23. The system of claim 17, further comprising:

an EPA Tier 4 certified control system wherein the generator is operable in emergency and non-emergency applications, the control system being inducement-resilient whereby a malfunction or failure of the SCR system during non-emergency use does not trigger an engine shutdown, thereby maintaining mission critical availability of the engine.

24. The system of claim 17, wherein reduced voltage and frequency deviations during AI workloads result in fewer transitions of an uninterruptible power supply (UPS) to battery mode, thereby improving UPS operational lifespan.

25. The system of claim 17, wherein the engine has a per-cylinder displacement of less than 10 liters.

26. The system of claim 17, wherein the generator system includes a medium-speed, large-displacement diesel engine in large multi-engine stationary power generation sites regulated under Title V or equivalent air quality permitting regimes.

27. The system of claim 17, wherein the engine and emissions treatment system operate without requiring a diesel oxidation catalyst (DOC) or diesel particulate filter (DPF) to comply with EPA Tier 4 emissions regulations of carbon monoxide (CO) and particulate matter (PM) limits.

28. The system of claim 23, wherein the system includes inducement-resilient architecture with reliable operation in both emergency and non-emergency mission-critical applications, reducing risk of emissions-related shutdown and enhancing system availability.

29. The system of claim 17, further comprising:

an Active Diesel Particulate Filter (ADPF) configured to reduce particulate matter emissions and optionally function as a sound attenuation device, wherein the ADPF replaces or supplements the exhaust silencer.

30. The system of claim 17, further comprising:

a passive diesel oxidation catalyst (DOC) positioned downstream of the engine and wherein the DOC is configured to further remove CO.

31. The system of claim 17, wherein the selective catalytic reduction (SCR) unit is configured to receive aqueous ammonia as the reductant, the aqueous ammonia providing improved low-temperature reactivity compared to urea, thereby enabling earlier and more efficient reductant dosing during cold-start and transient operation, reducing uncontrolled operation of the SCR system and enhancing overall emissions control performance.

32. The system of claim 17, wherein the ultra-low nitrogen oxide (NOx) emissions performance enables developers to:

(a) deploy larger multi-engine stationary generator installations in emissions-constrained regions without exceeding Title V or local air quality permitting thresholds, thereby maximizing build-out capacity; and (b) accelerate grid interconnections by providing sufficient emissions margin to qualify the generator system for ancillary services, demand response, and distributed energy resource participation under Federal Energy Regulatory Commission (FERC) Orders 845 or 2222 or other equivalent international regulating bodies or electric utilities governing interconnection requirements.

* * * * *